US006135027A

United States Patent [19]

Rudzewitz et al.

[11] Patent Number: 6,135,027

[45] Date of Patent: Oct. 24, 2000

[54] DEVICE FOR IN-REGISTER POSITIONING OF A PRINTING PLATE

[75] Inventors: Stephan Rudzewitz, Walldorf; Frank Schumann, Heidelberg, both of Germany

[73] Assignee: Heidelberger Druckmaschinen Aktiengesellschaft, Heidelberg, Germany

[21] Appl. No.: 09/243,838

[22] Filed: Feb. 1, 1999

[30] Foreign Application Priority Data

Jan. 30, 1998 [DE] Germany ..... 198 03 725

[51] Int. Cl.[7] ..... B41F 1/28

[52] U.S. Cl. ..... 101/415.1; 101/477; 101/DIG. 36

[58] Field of Search ..... 101/378, 382.1, 101/383, 415.1, 485, 486, 477, DIG. 36; 33/614, 617, 619, 620, 621

[56] References Cited

U.S. PATENT DOCUMENTS

| | | | |
|---|---|---|---|
| 5,320,041 | 6/1994 | Maejima et al. | 101/415.1 |
| 5,461,980 | 10/1995 | Maejima et al. | 101/415.1 |
| 5,479,859 | 1/1996 | Lindner et al. | 101/485 |
| 5,492,060 | 2/1996 | Haaf et al. . | |
| 5,497,703 | 3/1996 | Becker | 101/415.1 |
| 5,537,926 | 7/1996 | Beisel et al. . | |
| 5,555,810 | 9/1996 | Stiel | 101/477 |
| 5,555,812 | 9/1996 | Ruckmann et al. | 101/477 |

FOREIGN PATENT DOCUMENTS

| | | |
|---|---|---|
| 0 520 598 A1 | 12/1992 | European Pat. Off. . |
| 0 551 976 B1 | 7/1993 | European Pat. Off. . |
| 0 579 017 A1 | 1/1994 | European Pat. Off. . |
| 0 581 212 A1 | 2/1994 | European Pat. Off. . |
| 0 653 301 A1 | 5/1995 | European Pat. Off. . |
| 0 711 664 A1 | 5/1996 | European Pat. Off. . |
| 77 28 905 | 1/1979 | Germany . |
| 35 27 103 A1 | 10/1986 | Germany . |
| 43 06 677 A1 | 9/1994 | Germany . |
| 42 26 780 C2 | 12/1994 | Germany . |
| 43 27 013 C1 | 1/1995 | Germany . |
| 43 44 090 A1 | 6/1995 | Germany . |
| 195 08 844 A1 | 9/1996 | Germany . |
| 43 32 803 C2 | 10/1996 | Germany . |
| 296 15 902 U1 | 2/1997 | Germany . |
| 41 30 359 C2 | 4/1997 | Germany . |
| 196 11 530 C1 | 10/1997 | Germany . |
| 196 36 703 A1 | 3/1998 | Germany . |
| 2 275 655 | 9/1994 | United Kingdom . |

*Primary Examiner*—Ren Yan
*Attorney, Agent, or Firm*—Herbert L. Lerner; Laurence A. Greenberg; Werner A. Stemer

[57] ABSTRACT

A device for in-register positioning of a printing plate for mounting it on a plate cylinder of a printing press, includes at least two positioning pins engageable for in-register positioning exactly in recesses formed in a printing plate leading edge, and sensors for detecting the exact engagement and for transmitting a corresponding signal, at least one positioning pin and at least one recess on one side of the printing plate leading edge having noninterchangeable engagement positions in relation to at least one positioning pin and at least one recess on another side of the printing plate leading edge which is opposite to the one side thereof with respect to a center line of the printing plate.

18 Claims, 4 Drawing Sheets

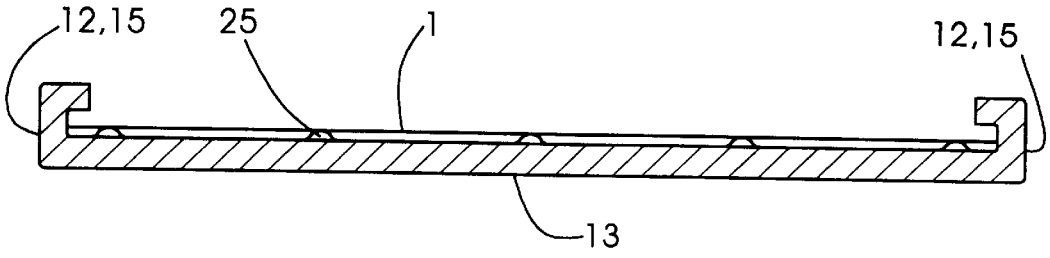
Fig.2a
Fig.2
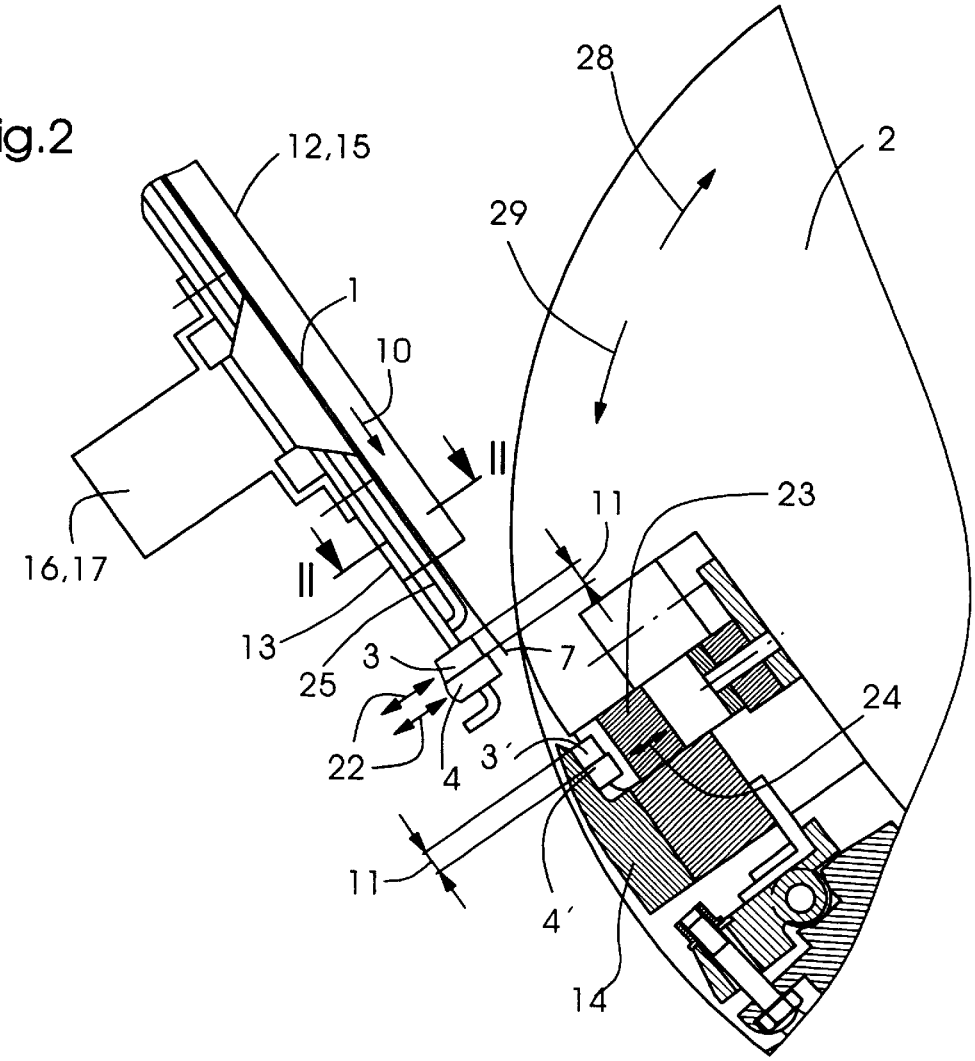

DEVICE FOR IN-REGISTER POSITIONING OF A PRINTING PLATE

BACKGROUND OF THE INVENTION

FIELD OF THE INVENTION

The invention relates to a device for in-register positioning of a printing plate for mounting on a plate cylinder of a printing press, with at least two positioning pins engageable exactly into recesses on a printing plate leading edge for in-register positioning, and including sensors for detecting the exact engagement and transmitting a corresponding signal.

Devices of this general type have become known heretofore from the published European Patent Documents EP 0 581 212 A1 and EP 0 551 976 B1. In these devices, the leading edge clamping device of a plate cylinder has positioning pins attached thereto which, in the exact engagement position thereof, close a circuit via the inserted printing plate and emit a signal. With these devices, however, it is not possible to prevent the correct positioning of a printing plate from being signalled, even when it is inserted in a laterally transposed manner, and the laterally transposed insertion therefore remains unrecognized. Furthermore, checking the correct positioning of a printing plate is restricted to insertion into the leading edge clamping device of a plate cylinder. Moreover, only printing plates made of electrically conductive material can be detected.

SUMMARY OF THE INVENTION

It is accordingly an object of the invention to provide a device for in-register positioning of a printing plate wherein printing plates which have been inserted in a laterally transposed manner are also recognized.

With the foregoing and other objects in view, there is provided, in accordance with the invention, a device for in-register positioning of a printing plate for mounting it on a plate cylinder of a printing press, comprising at least two positioning pins engageable for in-register positioning exactly in recesses formed in a printing plate leading edge, and sensors for detecting the exact engagement and for transmitting a corresponding signal, at least one positioning pin and at least one recess on one side of the printing plate leading edge having noninterchangeable engagement positions in relation to at least one positioning pin and at least one recess on another side of the printing plate leading edge which is opposite to the one side thereof with respect to a center line of the printing plate.

In accordance with another feature of the invention, the positioning pins on the one side of the printing plate leading edge, and the positioning pins on the other side of the printing plate leading edge have an offset of the engagement positions in a direction of transport of the printing plate, the recesses being formed so as to correspond to the offset, and guides for guiding the printing plate on a path extending at right angles to the leading edge of the plate.

In accordance with a further feature of the invention, the positioning pin and its corresponding recess on the one side have different shapes from the positioning pin and its corresponding recess on the other side.

In accordance with an added feature of the invention, the positioning pin and the recess associated therewith on the one side are of round shape and the positioning pin and the recess associated therewith on the other side are of angular shape, the sensors being activatable for emitting a signal only when the respective positioning pins engage in the respective recesses associated therewith.

In accordance with an additional feature of the invention, the guides are arranged on a plate feeding device.

In accordance with yet another feature of the invention, the guides are lateral U-shaped embracing portions.

In accordance with yet a further feature of the invention, the positioning pins are arranged on a leading edge clamping device of the plate cylinder.

In accordance with yet an added feature of the invention, the positioning pins are arranged at a lower end of a plate feeding device.

In accordance with yet an additional feature of the invention, the positioning pins of the plate feeding device are movable away so as to transfer the printing plate onto a leading edge clamping device.

In accordance with still another feature of the invention, the plate feeding device has a holder for holding the printing plates in position during transfer thereof from positioning pins of the plate feeding device to positioning pins of a leading edge clamping device.

In accordance with still a further feature of the invention, the holder is at least one lifting sucker.

In accordance with still an added feature of the invention, the sensors are electric contacts for closing a circuit when the positioning pins engage exactly in the recesses.

In accordance with still an additional feature of the invention, the positioning pins are formed of conductive material in only a subregion on a front side thereof.

In accordance with a first alternative feature of the invention, the sensors are formed as capacitive sensors.

In accordance with a second alternative feature of the invention, the sensors are optical sensors.

In accordance with a third alternative feature of the invention, the sensors are ultrasonic sensors.

In accordance with a fourth alternative feature of the invention, the sensors are inductively acting sensors.

In accordance with a fifth alternative feature of the invention, the sensors are microswitches.

In accordance with a concomitant feature of the invention, the positioning device includes resilient guide elements arranged within an operative range of the positioning pins for forcing the printing plate into the operative range of the positioning pins.

Assurance is thereby provided that, without any appreciable outlay, a printing plate is positioned not only in-register, but also laterally correctly. By use of the signal, the clamping operation can be stopped, a fault indication emitted or an automatic correction brought about.

The noninterchangeable engagement positions can be implemented in various ways:

In one proposal, the positioning pins on one side of the printing plate leading edge and the positioning pins on the other side of the printing plate leading edge have an offset of the engagement positions in the direction of transport of the printing plate, the recesses are formed to correspond to this offset, and the printing plate is guided by guides along a path extending at right angles to the leading edge of the printing plate.

Alternatively or in addition to this proposal, provision may be made for the positioning pin and its corresponding recess on one side to have different shapes from the positioning pin and its corresponding recess on the other side. Thus, the positioning pin and the recess associated therewith on one side of the printing plate leading edge may be of round shape, and the positioning pin and the recess associated therewith on the other side of the printing plate leading edge may be of angular shape, the sensors being activated for emitting a signal only when the positioning pins engage in the recesses associated therewith.

Other shapes are, of course, also possible, such as, for example, round positioning pins flattened on the front side thereof and engaging in recesses which are shaped round or straight at the bottom thereof.

The guides for guiding the printing plates on a path extending at right angles to the leading edge thereof may be arranged on a plate feeding device. Such guides may be formed, for example, as U-shaped embracing portions extending laterally relative to the path of the printing plates.

The positioning pins may be arranged on the leading edge clamping device of the plate cylinder, in order to ensure the correct positioning of the printing plates thereat.

In a particularly advantageous development, however, the plate feeding device is equipped with such positioning pins at a lower end thereof. It can then be determined whether a printing plate has already been made ready in the plate feeding device in-register and laterally correct. The great advantage of this development is that printing plates can be made ready correctly for the next printing order during the preceding printing order while the press is running. Any faults can also be detected and rectified while the press is running. The press shutdown time is thereby reduced, and delay caused by corrections is largely avoided. This increases the productivity and efficiency of the printing press, particularly in the case of multicolor printing presses, in which several printing plates have to be changed for the next printing order.

Moreover, there may be provision for the positioning pins of the plate feeding device to be movable away in order to transfer the printing plate onto the leading edge clamping device. In this case, it is particularly expedient if the plate feeding device has holders which hold the printing plates in their position during transfer from the positioning pins of the plate feeding device to the positioning pins of the leading edge clamping device. The in-register position of the printing plate is thereby maintained during the transfer, even if force were to be exerted on the printing plate as a result of a slight backward rotation of the plate cylinder for the purpose of inserting the printing plate leading edge into the leading edge clamping device. Register corrections of the printing plates attached to the plate cylinder are thus restricted to the customary fine corrections in order to coordinate the printing plates of the various inking units with one another. At least one, but preferably two lifting suckers are used as holders.

There are many possibilities for providing sensors for detecting the exact engagement of the positioning pins in the recesses of the printing plate:

One possibility, which is simple to implement, is for the sensors to be electric contacts which close a circuit, for example, via the printing plate, when the positioning pins engage exactly in the recesses of the printing plate leading edge. Advantageously, in this regard, the positioning pins are formed of conductive material in only a subregion on a front side thereof, in order to ensure that electrical contact occurs only when the positioning pins are located entirely in the recesses.

Capacitively or inductively acting sensors may, however, also be employed as sensors. If plastic printing plates are to be used, optical sensors, ultrasonic sensors or microswitches may also be provided.

If printing plates which have already been used once for printing are used, there is a problem that they may have developed a curve or bend and could therefore slide past the positioning pins. This applies, in particular, to positioning pins arranged on the plate feeding device. To solve this problem, it is proposed that resilient guide elements be arranged within the operating or effective range of the positioning pins for forcing the printing plate into the operating range of the positioning pins.

Other features which are considered as characteristic for the invention are set forth in the appended claims.

Although the invention is illustrated and described herein as embodied in a device for in-register positioning of a printing plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 2 is a sectional view of an exemplary embodiment of the in-register positioning device according to the invention, with a printing plate feeding device;

FIG. 2*a* is a cross-sectional view of FIG. 2 taken along the line II—II through the plate feeding device;

DESCRIPTION OF THE PREFERRED EMBODIMENTS

Figure 1:
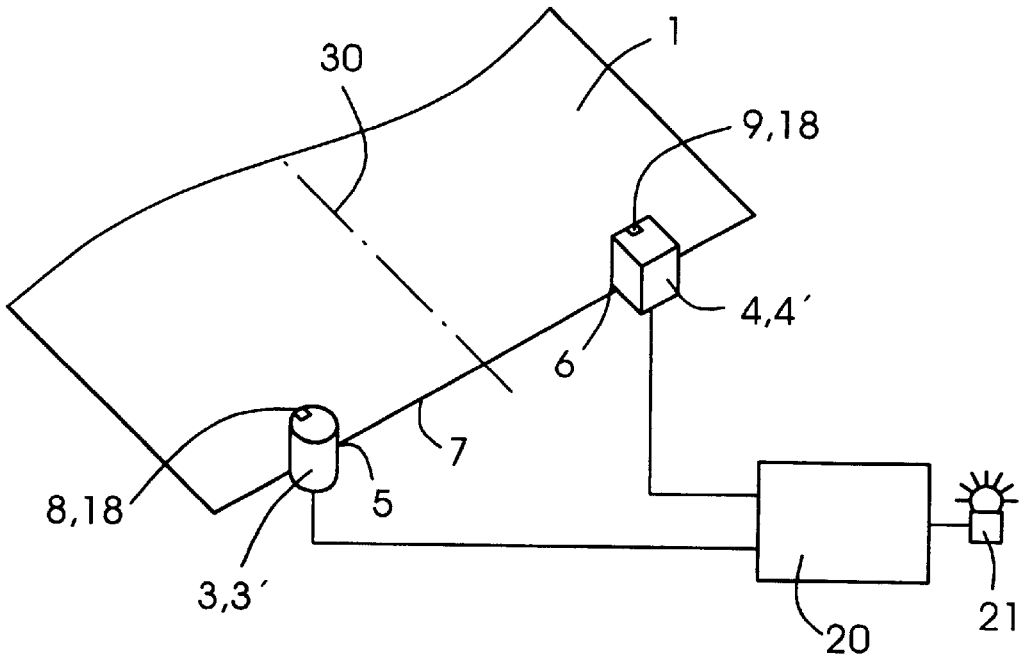
FIG. 1 is a basic diagram depicting the subject of the invention in one operating phase thereof.

Referring now to the figures of the drawings and, first, particularly to FIG. 1 thereof, there is shown therein a basic diagram of the subject of the invention, namely, an in-register positioning device. A printing plate 1 is formed with recesses 5 and 6 which are located, with respect to a center line 30, on opposite sides of a printing plate leading edge 7. The recesses 5 and 6, with respect to the shape thereof, are formed to correspond to the shape of positioning pins 3, 3' and/or 4, 4'. The positioning pins 3, 3', 4, 4' are provided, on a front side thereof, with sensors 8 and 9 which are formed here as electric contacts 18. In this regard, the shape of the recesses 5 and 6 and of the positioning pins 3, 3', 4, 4' is selected so electric contacting occurs only when the positioning pins 3 or 3' engage entirely in the recess 5 and the positioning pins 4 or 4' into the recess 6. For this purpose, as illustrated, the electric contacts 18 may also be arranged only in a subregion of the front side of the positioning pins 3, 4 or 3', 4', preferably in a middle region thereof. As a result of the electric contacting, the circuit is closed, and an evaluation device 20 receives a signal. The signal ensures that the clamping operation can be continued. Moreover, an indicator device 21 can signal this state.

Positioning pins of this type may be arranged both on a plate feeding device 13, as identified by reference numerals 3 and 4, and on a leading edge clamping device 14 of a plate cylinder 2, as identified by reference characters 3' and 4'. Round positioning pins 3 and 3' and angular positioning pins 4 and 4' are illustrated as possible shapes. Because the associated recesses 5 and 6 are U-shaped and angular, respectively, there would be no contacting if the printing plate 1 were inserted in a laterally transposed manner, and the clamping operation would be interrupted.

Figure 1A:
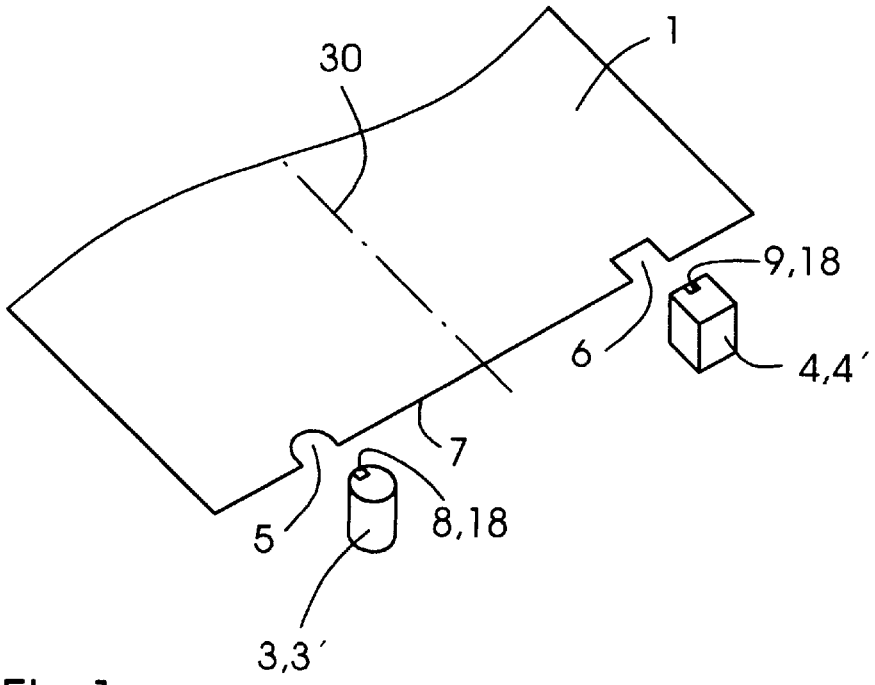
FIG. 1*a* is the basic diagram of FIG. 1*a* showing the subject of the invention in another operating phase thereof.

FIG. 1*a* shows a somewhat differently constructed embodiment in an operating phase before the positioning pin 3 or 3' engages in the recess 5, and the positioning pin 4 or 4' in the recess 6. A round shape, but flattened at the front, was selected for the positioning pin 4 or 4' in this illustration, so that a positioning pin 4 or 4' in the recess 5 could not make any contact.

The sensors could, of course, also be formed in a different way, as already indicated hereinabove. It is essential, in this regard, that an indication be given only when the printing plate 1 is inserted laterally correctly and the positioning pins 3 and 4 or 3' and 4' come to bear entirely in the recesses 5 and 6.

FIG. 2 shows an embodiment with a plate feeding device 13 which serves for making ready a printing plate 1 to be fed to the leading edge clamping device 14 of a plate cylinder 2.

In an embodiment of this type, a printing plate 1 is introduced from above into the non-illustrated end of the plate feeding device 13, until the positioning pins 3 and 4 of the plate feeding device 13 engage in the recesses 5 and 6 on the printing plate leading edge 7. The positioning pins 3 and 4 are arranged on the lower end of the plate feeding device 13 and are displaceable in the direction of the double-headed arrows 22. For engagement in the recesses 5 and 6, which cannot be seen in this illustration, the positioning pins 3 and 4 are moved out upwardly to the right, so that they project above the level of the printing plate 1. In order to prevent a laterally transposed insertion of the printing plate 1, in this embodiment, the positioning pins 3 and 4 have been arranged with an offset 11, as seen in the direction of transport 10 of the printing plate 1, guides 12 ensuring that the printing plate 1 is guided in a straight line, and the recesses 5 and 6 on the printing plate 1 being arranged with the same offset 11.

FIG. 2*a* shows a section taken along the line II—II in FIG. 2 through the plate feeding device 13. Provided on both sides of the plate feeding device 13 are U-shaped embracing portions 15 which guide the printing plate 1 in a straight line and thereby also ensure that, in the case of laterally transposed insertion of the printing plate 1, contacting and consequently a fault indication cannot occur as the result of an oblique or inclined position. In addition, sliding devices 25 for undamaged transport of the printing plates 1 are provided. These may be rollers or beads provided with sliding media.

When a printing plate leading edge 7 engagingly encircles the positioning pins 3 and 4 with its recesses 4 and 5 in the plate feeding device 13 of FIG. 2, a signal is given which, by virtue of the in-register and laterally correct positioning, indicates that a new printing plate 1 is correctly made ready. Thereupon, the lifting suckers 17, which are located above the positioning pins 3 and 4, are moved in the direction of the printing plate 1 and grasp it in order to fix its position. The positioning pins 3 and 4 are then drawn back into the position shown. The plate cylinder 1 rotates backwards in the direction of the arrow 28, until the leading edge clamping device 14 has received the printing plate leading edge 7.

The leading edge clamping device 14 also has positioning pins arranged with the same offset distance 11. These may be positioning pins with or without sensors 8, 9. Positioning pins 3' and 4', which are equipped with sensors 8 and 9 and which engage in the recesses 4 and 5, are illustrated. When this engagement has taken place correctly, the sensors 8 and 9 arranged there also emit a signal. Thereupon, the leading edge clamping device 14 closes due to the closing of the movable clamping jaw 23. The clamping and releasing movement of the movable clamping jaw 23 is indicated by the double-headed arrow 24. The lifting suckers 17 then release the printing plate, and the plate cylinder 2 rotates forward in the direction of the arrow 29, in order to receive on its circumference the printing plate 1.

As a rule, the printing plate trailing edge is then also inserted into a printing plate trailing edge clamping device and gripped and the printing plate 1 is clamped. In the case of multicolor printing presses, this operation may take place simultaneously or with a time overlap, but also in succession, on a plurality of printing units. By making ready all the printing plates 1 so that they are in-register and laterally correct, it is possible to shorten the press shutdown time and reduce to a minimum the corrections to be carried out during the stoppage of the press.

Figure 3:
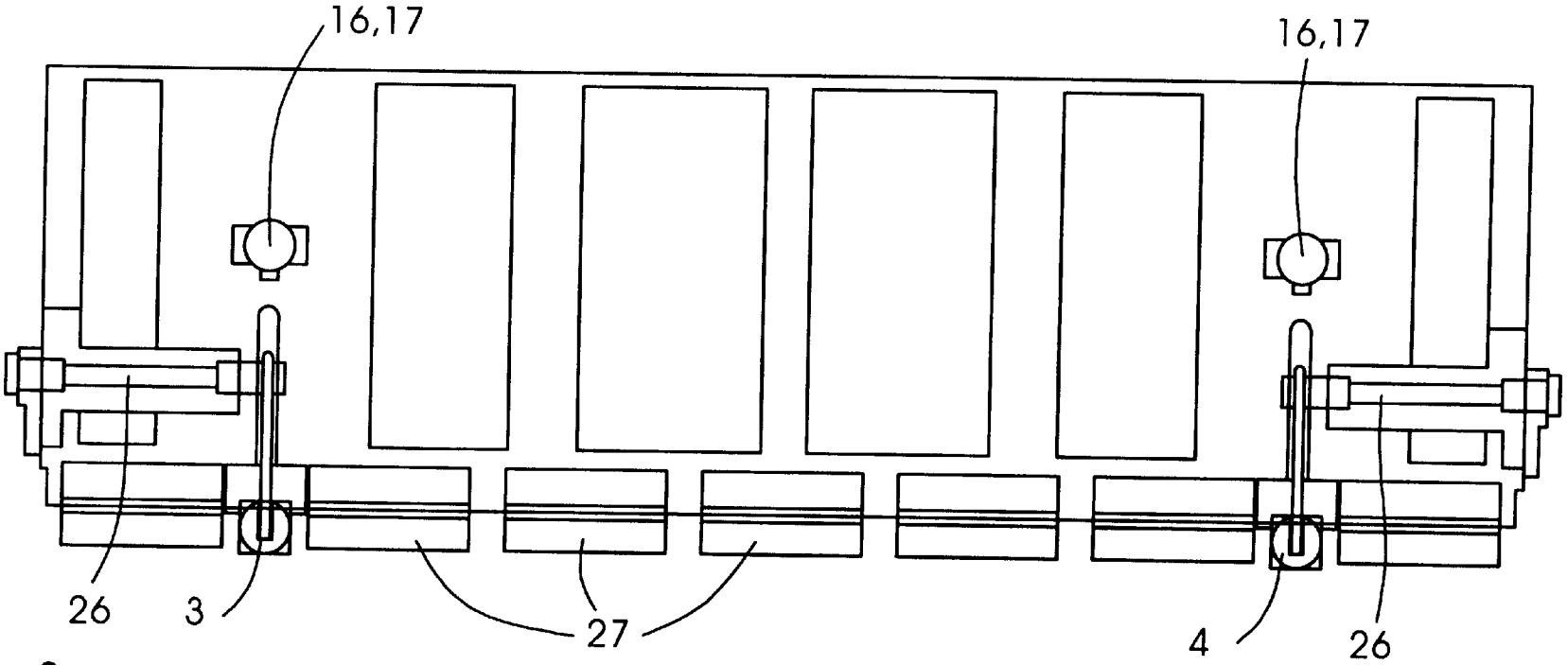
FIG. 3 is a fragmentary plan view of an exemplary embodiment of the plate feeding device.

FIG. 3 shows a subregion of an exemplary embodiment of a plate feeding device 13. This illustrates the positioning pins 3 and 4 which are arranged at the lower end and which can be displaced by drives 26 in the manner shown by the double-headed arrows in FIG. 2. Arranged above the positioning pins 3 and 4 are holders 16 which are formed as lifting suckers 17, the function of which was described hereinabove. Rollers 27 at the end of the plate feeding device 13 ensure the undamaged guidance of the printing plates 1 in the end region of the plate feeding device 13 during transfer onto the plate cylinder 2.

Figure 4:
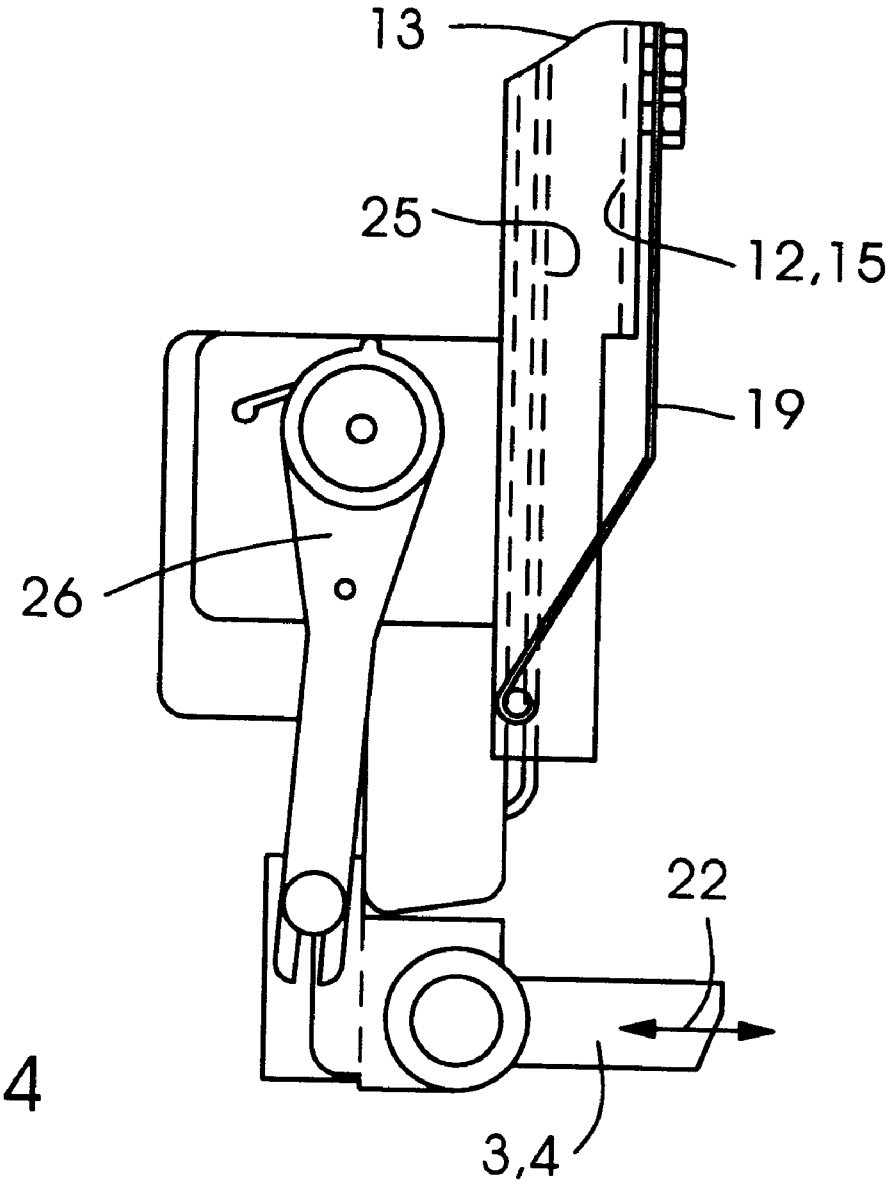
FIG. 4 is a side elevational view of a detail of the plate feeding device.

FIG. 4 shows a detail of a plate feeding device 13. In addition to the elements already described, a resilient guide element 19 is provided, which ensures that printing plates 1 which have already been used once for printing and which have become curved or bent are also guided in such a way that the positioning pins 3 and 4 engage in the recesses 5 and 6. Even printing plates 1 such as these can thereby be handled without any problems.

The exemplary embodiments are, of course, merely by way of example. It is also possible for only the leading edge clamping device 14 of the plate cylinder 2 to be equipped with positioning pins 3' and 4' having sensors 7 and 8. Other feature combinations may also be envisioned.

We claim:

1. A device for in-register positioning of a printing plate to be mounted on a plate cylinder of a printing press, the device comprising:

a printing plate for mounting on a plate cylinder, said printing plate including a printing plate leading edge having a centerline and two sides opposing each other relative to said centerline, said printing plate leading edge having recesses formed therein;

at least two positioning pins engageable in an exact engagement with said recesses, at least one of said at least two positioning pins and at least one of said recesses on a first of said sides having noninterchangeable engagement positions in relation to at least one of said at least two positioning pins and at least one of said recesses on a second of said sides, said at least two positioning pins having an offset of said engagement positions in a direction of transport of said printing plate, said recesses being formed so as to correspond to said offset;

sensors for detecting said exact engagement and for transmitting a corresponding signal; and guides for guiding the printing plate on a path extending at right angles to the leading edge of the plate.

2. The positioning device according to claim 1, wherein the positioning pin and its corresponding recess on said one side have different shapes from the positioning pin and its corresponding recess on said other side.

3. The positioning device according to claim 1, wherein the positioning pin and the recess associated therewith on said one side are of round shape and the positioning pin and the recess associated therewith on said other side are of angular shape, said sensors being activatable for emitting a signal only when the respective positioning pins engage in the respective recesses associated therewith.

4. The positioning device according to claim 1, wherein said guides are arranged on a plate feeding device.

5. The positioning device according to claim 4, wherein said guides are lateral U-shaped embracing portions.

6. The positioning device according to claim 1, wherein said positioning pins are arranged on a leading edge clamping device of the plate cylinder.

7. The positioning device according to claim 1, wherein said positioning pins are arranged at a lower end of a plate feeding device.

8. The positioning device according to claim 7, wherein said positioning pins of said plate feeding device are movable away so as to transfer the printing plate onto a leading edge clamping device.

9. The positioning device according to claim 7, wherein said plate feeding device has a holder for holding the printing plates in position during transfer thereof from positioning pins of said plate feeding device to positioning pins of a leading edge clamping device.

10. The positioning device according to claim 9, wherein said holder is at least one lifting sucker.

11. The positioning device according to claim 1, wherein said sensors are electric contacts for closing a circuit when said positioning pins engage exactly in said recesses.

12. The positioning device according to claim 11, wherein said positioning pins are formed of conductive material in only a subregion on a front side thereof.

13. The positioning device according to claim 1, wherein said sensors are formed as capacitive sensors.

14. The positioning device according to claim 1, wherein said sensors are optical sensors.

15. The positioning device according to claim 1, wherein said sensors are ultrasonic sensors.

16. The positioning device according to claim 1, wherein said sensors are inductively acting sensors.

17. The positioning device according to claim 1, wherein said sensors are microswitches.

18. The positioning device according to claim 1, including resilient guide elements arranged within an operative range of said positioning pins for forcing the printing plate into said operative range of said positioning pins.

* * * * *